US006139257A

United States Patent [19]

Proctor et al.

[11] Patent Number: 6,139,257

[45] Date of Patent: Oct. 31, 2000

[54] SHROUD COOLING ASSEMBLY FOR GAS TURBINE ENGINE

[75] Inventors: Robert Proctor; Edward P. Brill, both of West Chester, Ohio; Randall B. Rydbeck, South Hamilton, Mass.; John W. Hanify, West Chester; Gregory A. White, Cincinnati, both of Ohio

[73] Assignee: General Electric Company, Cincinnati, Ohio

[21] Appl. No.: 09/249,205

[22] Filed: Feb. 12, 1999

Related U.S. Application Data

[63] Continuation-in-part of application No. 09/046,337, Mar. 23, 1998.

[51] Int. Cl.[7] ..... F01D 25/08

[52] U.S. Cl. ..... 415/115; 415/116

[58] Field of Search ..... 415/108, 115, 415/116, 176, 178, 213.1, 214.1

[56] References Cited

U.S. PATENT DOCUMENTS

| | | | |
|---|---|---|---|
| 3,583,824 | 6/1971 | Smuland | 415/117 |
| 3,975,112 | 8/1976 | Brown et al. | 451/116 |
| 4,157,232 | 6/1979 | Bobo et al. | 415/116 |
| 4,303,371 | 12/1981 | Eckert | 415/116 |
| 4,317,646 | 3/1982 | Steel et al. | 415/116 |
| 4,497,610 | 2/1985 | Richardson et al. | 415/116 |
| 4,551,064 | 11/1985 | Pask | 415/116 |
| 4,573,865 | 3/1986 | Hsia et al. | 415/115 |
| 4,573,866 | 3/1986 | Sandy, Jr. et al. | 415/116 |
| 5,165,847 | 11/1992 | Proctor et al. | 415/115 |
| 5,167,487 | 12/1992 | Rock | 415/173.3 |
| 5,169,287 | 12/1992 | Proctor et al. | 415/115 |
| 5,584,651 | 12/1996 | Pietraszkiewicz et al. | 415/115 |
| 5,964,575 | 10/1999 | Marey | 415/115 |

FOREIGN PATENT DOCUMENTS 2091402 3/1990 Japan .

*Primary Examiner*—Ninh Nguyen

*Attorney, Agent, or Firm*—Andrew C. Hess; Rodney M. Young

[57] ABSTRACT

To cool the shroud assembly in the high pressure turbine section of a gas turbine engine, high pressure cooling air is directed in metered flow to baffle plenums and thence through baffle perforations to impingement cool the rails and back surfaces of the shroud. Impingement cooling air then flows through elongated, convection cooling passages in the shroud sections and exits to flow along the shroud front surface with the main gas stream to provide film cooling. The aft rail of the shroud sections is provided with one or more cooling holes to impingement cool the annular retaining ring or C-clip retaining the shroud sections on the shroud hangers. This cooling air then travels aftward on the inboard side of the C-clip to provide convection cooling of the C-clip. In an alternative embodiment, cooling air is directed at the aft corners of the shroud base to avoid overheating.

9 Claims, 4 Drawing Sheets

SHROUD COOLING ASSEMBLY FOR GAS TURBINE ENGINE

This is a continuation-in-process of Ser. No. 09/046,337 filed Mar. 23, 1998.

FIELD OF THE INVENTION

The present invention relates to gas turbine engines and particularly to cooling the shroud assembly surrounding the rotor in the high pressure turbine section of a gas turbine engine.

BACKGROUND OF THE INVENTION

To increase the efficiency of gas turbine engines, a known approach is to raise the turbine operating temperature. As operating temperatures are increased, the thermal limits of certain engine components may be exceeded, resulting in material failure or, at the very least, reduced service life. In addition, the increased thermal expansion and contraction of these components adversely affects clearances and their interfitting relationships with other components of different thermal coefficients of expansion. Consequently, these components must be cooled to avoid potentially damaging consequences at elevated operating temperatures. It is common practice then to extract from the main airstream a portion of the compressed air at the output of the compressor for cooling purposes. So as not to unduly compromise the gain in engine operating efficiency achieved through higher operating temperatures, the amount of extracted cooling air should be held to a small percentage of the total main airstream. This requires that the cooling air be utilized with utmost efficiency in order to maintain the temperatures of these components within safe limits.

One gas turbine component which is subjected to extremely high temperatures is the shroud assembly which is located immediately downstream of the high pressure turbine nozzle. The shroud assembly closely surrounds the rotor of the high pressure turbine and thus defines the outer boundary of the extremely high temperature, energized gas stream flowing through the high pressure turbine. Adequate cooling of the shroud assembly is necessary to prevent part failure and to maintain proper clearance with the rotor blades of the high pressure turbine.

Furthermore, during engine operation the aft corners of the shroud are the hottest parts of the shroud. The aft corners are exposed to hot combustion gases that leak between adjacent shroud sections. Also, the aft corners are exposed to hot streaks, or regions of locally increased gas temperature as a result of uneven conditions around the circumference of the combustor. Excessive temperatures in the shroud can result in shroud distress, increased shroud leakage, and reduced engine performance.

A typical shroud assembly comprises a plurality of shroud hangers which are supported from the engine outer case and which in turn support a plurality of shroud sections. The shroud sections are held in place, in part, by an arcuate retainer or a plurality of arcuate retainers commonly referred to as C-clips. Pressurized cooling air is introduced through metering holes formed in the shroud hangers to baffle plenums disposed between the shroud hangers and the shroud sections. These baffle plenums are defined by pan-shaped baffles affixed to the hangers. Each baffle is provided with a plurality of perforations through which streams of air are directed into impingement cooling contact with the back or radially outer surface of the associated shroud section.

To achieve convection mode cooling, the shroud sections are provided with a plurality of passages extending there-through. The baffle perforations are judiciously positioned such that the impingement cooling air contacting the shroud sections flows through the passages to provide convection cooling of the shroud sections. The convection cooling air exiting the passages then flows along the radially inner surfaces of the shroud sections to afford film cooling of the shroud. One element of the shroud assembly which does not receive direct cooling in this arrangement is the aforementioned C-clip. The result is that high operating temperatures can lead to overheating and possible failure of the C-clip. Accordingly, there is a need for a shroud assembly with improved cooling of the C-clip.

SUMMARY OF THE INVENTION

The above-mentioned needs are met by the present invention in which impingement cooling air is directed onto the C-clips through one or more cooling holes formed through the aft rail of the shroud sections. Pressurized cooling air is introduced to baffle plenums through metering holes formed in the shroud hangers supporting the shroud sections. The cooling holes extend axially through the shroud section aft rail in fluid communication with the baffle plenums. The cooling holes are located radially inwardly from the rearwardly extending flange of the aft rail which is engaged by the C-clip, so as to direct cooling air directly onto the C-clip. After the cooling air impinges on the base of the C-clip, it then travels aftward on the inboard side of the C-clip to provide convection cooling of the C-clip.

In another embodiment, one or more of the cooling holes formed in the aft rail of the shroud sections are arranged to impingement cool the aft corners of the shroud and to pressurize the aft cavity between the base of the shroud section and the C-clip in order to prevent hot gas ingestion and consequent overheating of the aft corners of the shroud. Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

Corresponding reference numerals refer to like parts throughout the several views of the drawings.

DETAILED DESCRIPTION OF THE INVENTION

Figure 1:
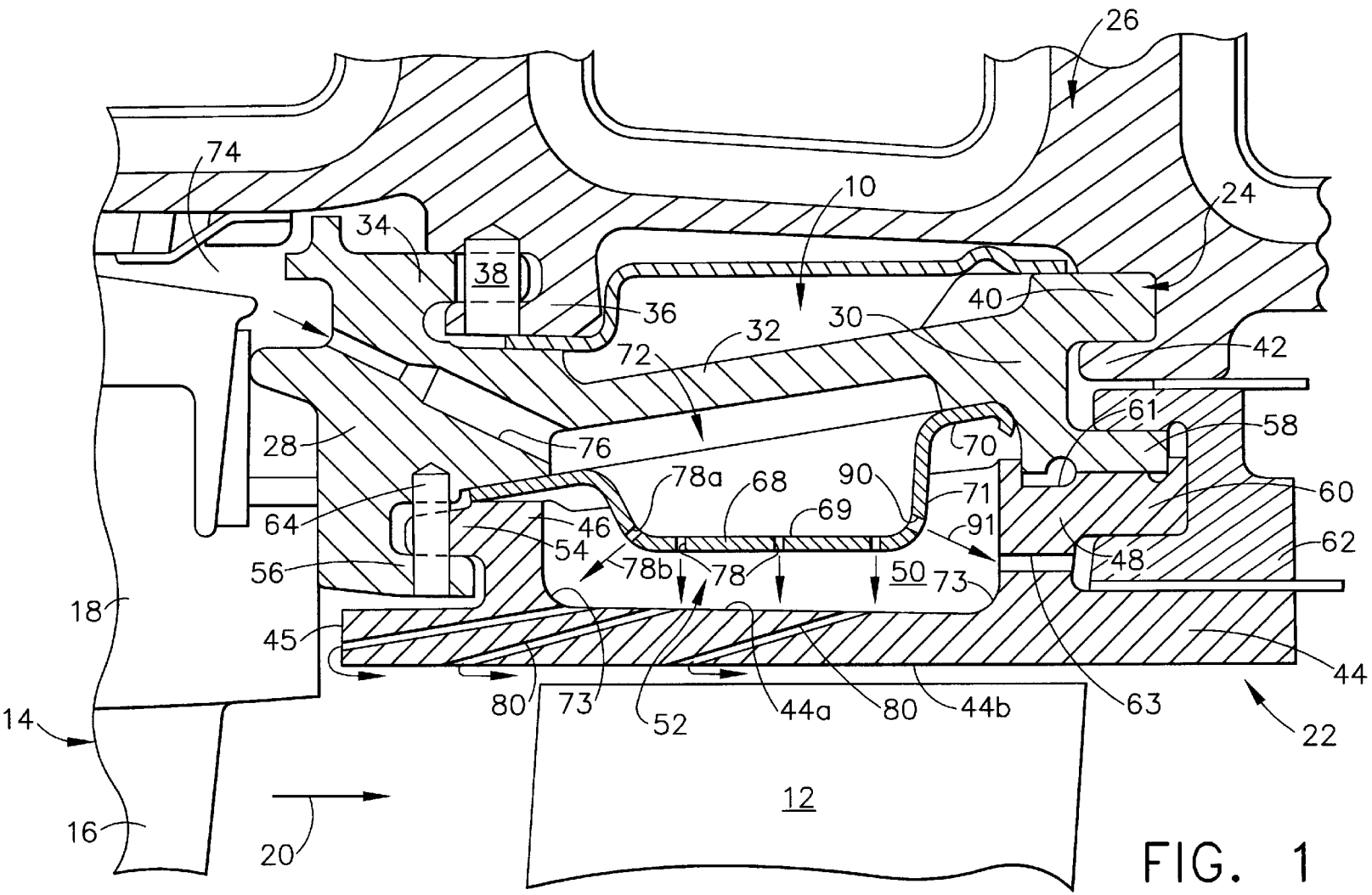
FIG. 1 is an axial sectional view of a shroud assembly constructed in accordance with the present invention.

The shroud assembly of the present invention, generally indicated at 10 in FIG. 1, is disposed in closely surrounding relation with turbine blades 12 carried by the rotor (not shown) in the high pressure turbine section of a gas turbine engine. A turbine nozzle, generally indicated at 14, includes a plurality of vanes 16 affixed to an outer band 18 for directing the main or core engine gas stream, indicated by arrow 20, from the combustor (not shown) through the high pressure turbine section to drive the rotor in traditional fashion.

Shroud assembly 10 includes a shroud in the form of an annular array of arcuate shroud sections, one generally indicated at 22, which are held in position by an annular array of arcuate shroud hanger sections, one generally indicated at 24, and, in turn, are supported by the engine outer case, generally indicated at 26. More specifically, each hanger section includes a fore or upstream rail 28 and an aft or downstream rail 30 integrally interconnected by a body panel 32. The fore rail is provided with a rearwardly extending flange 34 which radially overlaps a forwardly extending flange 36 carried by the outer case. A pin 38, staked to flange 36, is received in a notch in flange 34 to angularly locate the position of each hanger section. Similarly, the aft rail is provided with a rearwardly extending flange 40 in radially overlapping relation with a forwardly extending outer case flange 42 for the support of the hanger sections from the engine outer case.

Each shroud section 22 is provided with a base 44 having radially outerwardly extending fore and aft rails 46 and 48, respectively. These rails are joined by radially outwardly extending and angularly spaced side rails 50, best seen in FIG. 2, to provide a shroud section cavity 52. Shroud section fore rail 46 is provided with a forwardly extending flange 54 which overlaps a flange 56 rearwardly extending from hanger section fore rail 28 at a location radially inward from flange 34. A flange 58 extends rearwardly from hanger section aft rail 30 at a location radially inwardly from flange 40 and is held in lapping relation with an underlying flange 60 rearwardly extending from shroud section aft rail 48 by a generally arcuate retainer 62 of C-shaped cross section, commonly referred to as a C-clip. This retainer may take the form of a single ring with a gap for thermal expansion or may be comprised by multiple arcuate retainers. Pins 64, carried by the hanger sections, are received in notches 66 (FIG. 2) in the fore rail shroud section flanges 54 to locate the shroud section angular positions as supported by the hanger sections.

Pan-shaped baffles 68 are affixed at their brims 70 to the hanger sections 24 by suitable means, such as brazing, at angularly spaced positions such that a baffle is centrally disposed in each shroud section cavity 52. Each baffle thus defines, with the hanger section to which it is affixed, a baffle plenum 72. In practice, each hanger section may mount three shroud sections and a baffle section consisting of three circumferentially spaced baffles 68, one associated with each shroud section. Each baffle plenum 72 then serves a complement of three baffles and three shroud sections. High pressure cooling air extracted from the output of a compressor (not shown) immediately ahead of the combustor is routed to an annular nozzle plenum 74 from which cooling air is forced into each baffle plenum through metering holes 76 provided in the hanger section fore rails 28. It will be noted the metering holes 76 convey cooling air directly from the nozzle plenum to the baffle plenums to minimize leakage losses. From the baffle plenums high pressure air is forced through perforations 78 in the baffles as cooling airstreams impinging on the back or radially outer surfaces 44*a* of the shroud section bases 44. The impingement cooling air then flows through a plurality of elongated passages 80 through the shroud section bases 44 to provide convection cooling of the shroud. Upon exiting these convection cooling passages, cooling air flows rearwardly with the main gas stream along the front or radially inner surfaces 44*b* of the shroud sections to further provide film cooling of the shroud.

Figure 2:
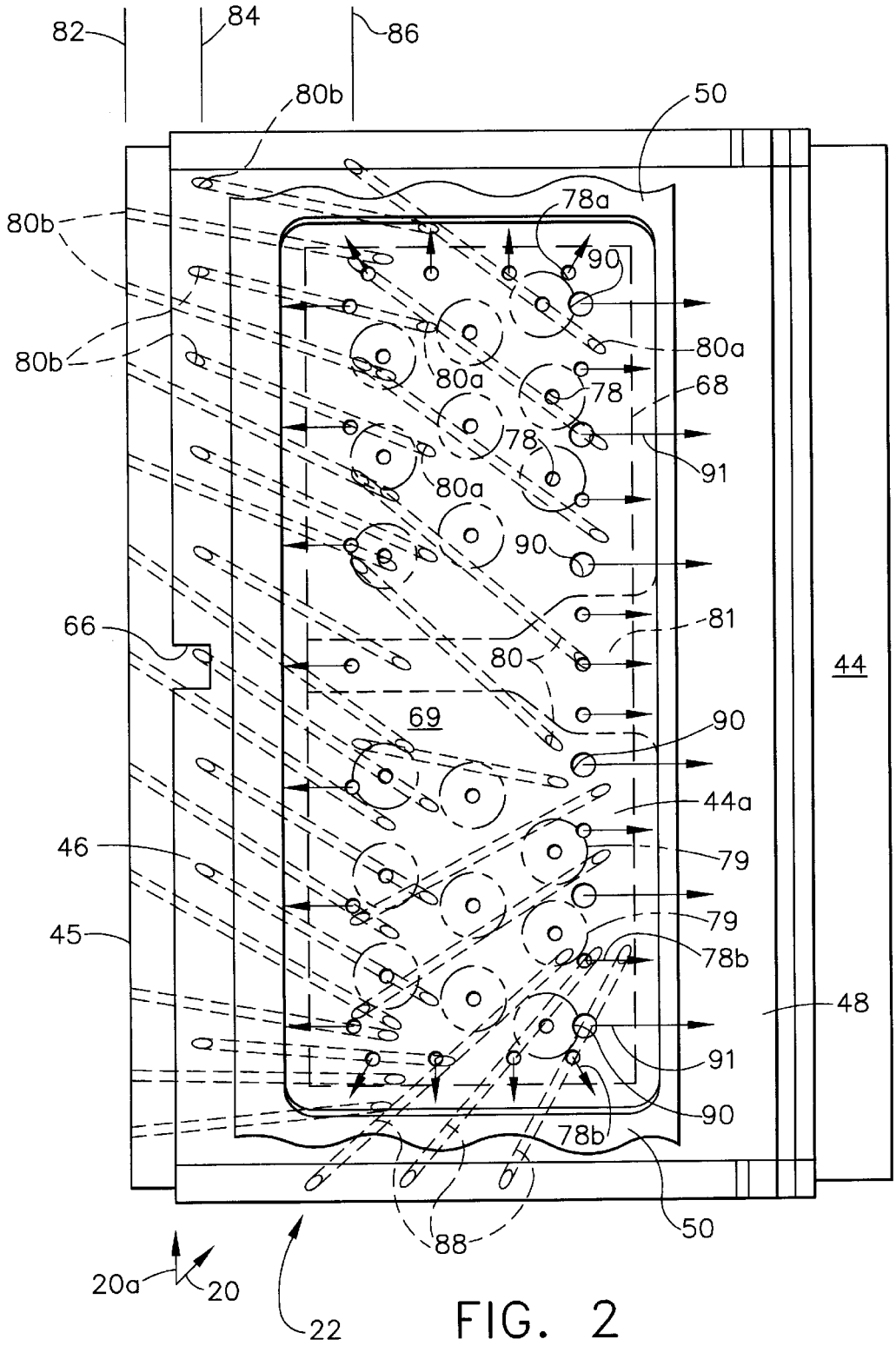
FIG. 2 is a plan view of a shroud section seen in FIG. 1.

The baffle perforations 78 and the convection cooling passages 80 are provided in accordance with a predetermined location pattern illustrated in FIG. 2 so as to maximize the effects of three cooling modes, i.e., impingement, convection and film cooling, which at the same time minimize the amount of compressor high pressure cooling air required to maintain shroud temperatures within tolerable limits. As seen in FIG. 2, the location pattern for perforations 78 in the bottom wall 69 of baffle 68 are in three rows of six perforations each. It is noted that a gap exists in the row pattern of perforations at mid-length coinciding with a shallow reinforcing rib 81 extending radially outwardly from shroud section base 44. The cooling airstreams flowing through these bottom wall perforations impinge on shroud back surface 44*a* generally over impingement cooling areas represented by circles 79. The bottom wall perforations are judiciously positioned such that the impingement cooled shroud surface areas (circles 79) avoid the inlets 80*a* of convection cooling passages 80. Consequently, virtually no impingement cooling air from these streams flows directly into the convection cooling passages, and thus impingement cooling of the shroud is maximized.

As seen in FIGS. 1 and 2, the baffle includes additional rows of perforations 78*a* in the sidewalls 71 adjacent bottom wall 69 to direct impingement cooling airstreams against the fillets 73 at the transitions between shroud section base 44 and the fore, aft and side rails, as indicated by arrows 78*b*. By impingement cooling the shroud at these uniformly distributed locations, heat conduction out through the shroud rails into the hanger and outer case is reduced. This heat conduction is further reduced by enlarging the normal machining relief in the radially outer surface of shroud flange 60, as indicated at 61, thus reducing the contact surface area between this flange and hanger flange 58. Limiting heat conduction out into the shroud hanger and outer case is an important factor in maintaining proper clearance between the shroud and the turbine blades 12.

However, even such limited heat conduction can produce overheating of the C-clip 62. Overheating of the C-clip 62 can lead to failure of the part. In accordance with the present invention, cooling air is provided directly to the C-clip 62 through a plurality of cooling holes 63 formed in the aft rail 48 of the shroud section 22. The cooling holes 63 extend axially (i.e., parallel to the axis of rotation of the turbine rotor) through aft rail 48 at a location radially inward of the flange 60 so that cooling air from the shroud section cavity 52 impinges directly on the base of the C-clip 62. In one preferred embodiment, six cooling holes 63 are spaced across each shroud section 22. This cooling air will significantly reduce the temperature of the C-clip 62.

In order to most effectively cool the C-clip, the air passing through the cooling holes 63 should be at the lowest temperature possible before flowing on the C-clip. As has been previously mentioned, the impingement effect on the shroud base 44 is maximized when the air flowing from baffle perforations 78 does not flow directly into the entrances 80*a* of shroud cooling holes 80. In order to more effectively cool C-clip 62, baffle 68 is provided with supplemental cooling holes 90 arranged within the axially rearward row of additional perforations 78*a* in baffle 68. In a preferred embodiment of the invention, the positions of supplemental cooling holes 90 are carefully located so as to be aligned in a one-to-one relationship with cooling holes 63. Supplemental cooling holes 90 are of larger diameter than the other holes in the row of perforations 78*a* to provide increased airflow.

Supplemental holes 90 are positioned so that cooling air 91 flowing out of the baffle 68 travels in a direct path from supplemental holes 90 to cooling holes 63, with as little impingement as possible on the surface of the shroud aft rail 48. This results in the minimum possible heating of the cooling air 91 before it flows onto C-clip 62. Cooling air 91 impinges on the base of the C-clip, then travels aftward on the inboard side of the C-clip to provide convection cooling of the C-clip. Thus the cooling effect upon the C-clip 62 is maximized.

Figure 3:
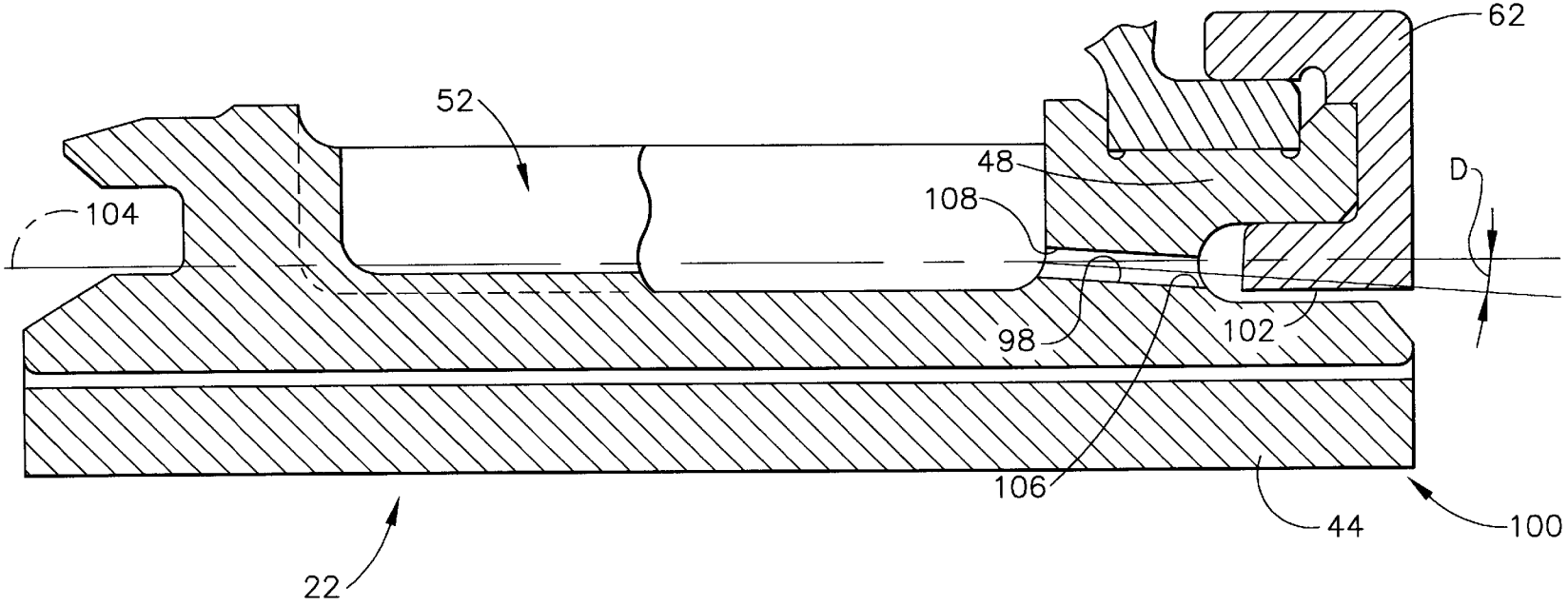
FIG. 3 is an axial sectional view of a shroud assembly constructed in accordance with an alternative embodiment of the present invention.
Figure 4:
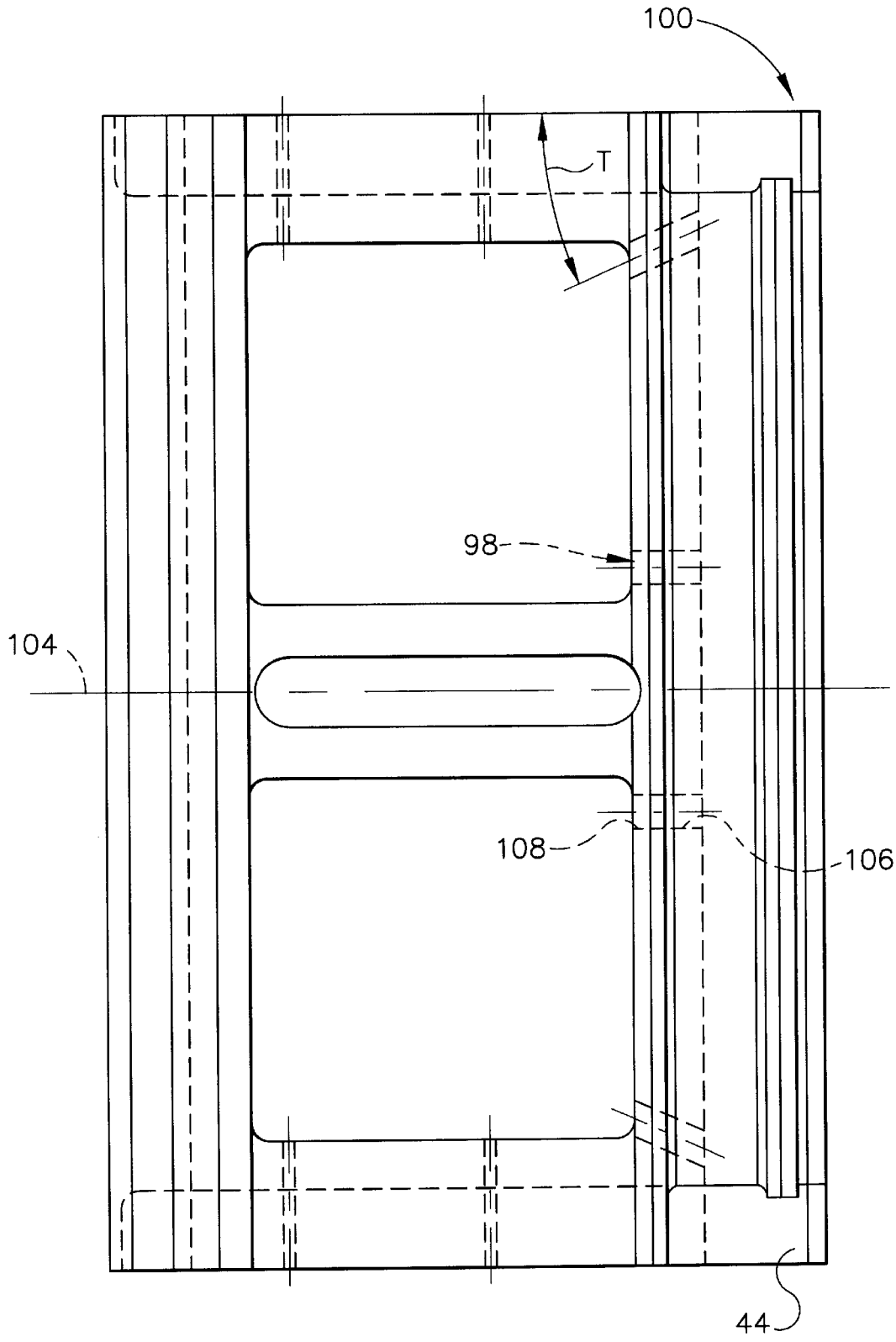
FIG. 4 is a plan view of a shroud section constructed in accordance with an alternative embodiment of the present invention.

In another embodiment of the invention, as best see in FIG. 3 and FIG. 4, one or more axial cooling holes 98 are formed in the aft rail 48 of the shroud section 22. Cooling air from the shroud section cavity 52 flows through holes 98 and may be directed onto the aft corners 100 of the base 44 of the shroud 22, thus providing impingement cooling of the aft corners 100. The cooling air flow from holes 98 may also be used to pressurize the shroud aft cavity 102, which is formed by the space between C-clip 62 and the base 44 of the shroud 22, to prevent the flow of hot combustion gases into the aft cavity 102. The cooling holes 98 may be substantially parallel to the axial centerline 104 of the shroud section 22, which is itself parallel to the longitudinal axis of the engine, or they may be angled away from the axis centerline 104, either inwardly or outwardly in a radial plane, or toward or away from the axial centerline 104 in a tangential direction, in order to direct pressurized cooling air flow as may be needed.

Preferably, at least one cooling hole 98 is arranged to flow cooling air directly onto one of the aft corners 100. To accomplish this, the axis of the hole 98 is placed at an angle T measured in the tangential direction from the axial centerline 104 of the shroud 22. This results in the aft end 106 of the hole 98 being disposed further away from the axial centerline 104 than the fore end 108 of the hole 98. The angle T may be in the range from about 20 degrees to about 70 degrees. Preferably, the angle T is in the range from about 35 degrees to about 55 degrees. More preferably, the angle T is in the range of about 39 degrees to about 44 degrees.

Preferably, the axis of the hole 98 is also placed at an angle D measured in a plane radial to the longitudinal axis of the engine, such that the aft end 106 of the hole 98 is disposed radially inwardly from the fore end 108 of the hole 98 in order to direct cooling air flow away from the C-clip 62 and directly upon the base 44 of the shroud section 22. The angle D may be in the range from about 0 degrees to about 45 degrees. Preferably, the angle D is in the range from about 0 degrees to about 7 degrees. More preferably, the angle D is in the range from about 1.8 degrees to about 2 degrees.

The quantity and size of cooling holes 98 are chosen to provide sufficient air to prevent hot gas ingestion in the aft cavity 102 while maintaining sufficient backflow margin of the cooling air to avoid causing hot gas ingestion into the shroud cavity 52. In a preferred embodiment, an array of four holes 98 are used, of which all four are disposed at the above-mentioned angle D, while the two holes 98 nearest the aft corners 100 of the shroud 22 are disposed at the above-mentioned angle T as well. Alternatively, the holes 98 can be disposed in any combination of angles T and/or D. In one embodiment, the holes 98 are not skewed at any angle T or D.

Referring again to FIG. 2, the location pattern for cooling passages 80 is generally in three rows, indicated by lines 82, 84 and 86 respectively aligned with the passage outlets **80*b*. It is seen that all of the passages 80** are straight, typically laser drilled, and extend in directions skewed relative to the engine axis, the circumferential direction, and the radial direction. This skewing affords the passages relatively long lengths, significantly greater than the base thickness, and increases their convection cooling surfaces. The number of convection cooling passages can then be reduced substantially, as compared to prior designs. With fewer cooling passages, the amount of cooling air can be reduced.

The passages of row 82 are arranged such that their outlets are located in the radial forward end surface 45 of shroud section base 44. As seen in FIG. 1, air flowing through these passages, after having impingement cooled the shroud back surface, not only convection cools the most forward portion of the shroud, but impinges upon and cools the outer band 18 of high pressure nozzle 14. Having served these purposes, the cooling air mixed with the main gas stream and flows along the base front surface **44*b* to film cool the shroud. The passages of rows 84 and 86 extend through the shroud section bases 44 from back surface inlets 80*a* to front surface outlets 80*b*** and convey impingement cooling air which then serves to convection cool the forward portion of the shroud. Upon exiting these passages, the cooling air mixes with the main gas stream and flows along the base front surface to film cool the shroud.

It will be noted from FIG. 2 that the majority of the cooling passages are skewed away from the direction of the main gas steam (arrow 20) imparted by the high pressure nozzle vanes 16 (FIG. 1). Consequently ingestion of the hot gases of this stream into the passages of rows 84 and 86 in counterflow to the cooling air is minimized. In addition, a set of three passages, indicated at 88, extend through one of the shroud section side rails 50 to direct impingement cooling air against the side rail of the adjacent shroud section. The convection cooling of one side rail and the impingement cooling of the other side rail of each shroud section beneficially serve to reduce heat conduction through the side rails into the hanger and engine outer case. In addition, these passages are skewed such that cooling air exiting therefrom flows in a direction opposite to the circumferential component **20*a*** of the main gas stream attempting to enter the gaps between shroud sections. This is effective in reducing the ingestion of hot gases into these gaps, and thus hot spots at these inter-shroud locations are avoided.

The foregoing has described a shroud assembly having improved cooling of the retainer commonly referred to as a C-clip and of the cavity disposed between the C-lip and the shroud base. While specific embodiments of the present invention have been described, it will be apparent to those skilled in the art that various modifications thereto can be made without departing from the spirit and scope of the invention as defined in the appended claims.

What is claimed is:

1. A shroud section for a gas turbine engine, said shroud section comprising:

a base having a fore end and an aft end;

a fore rail extending outwardly from said base at said fore end thereof, said fore rail having a proximal end and a distal end;

an aft rail extending outwardly from said base at said aft end thereof, said aft rail having a proximal end and a distal end, said aft rail having a cooling hole formed therein, wherein said cooling hole is disposed at an angle T toward or away from the axial centerline of said shroud section in a tangential direction.

2. The shroud section of claim 1 wherein said angle T is in the range from about 20 degrees to about 70 degrees.

3. A shroud assembly for a gas turbine engine, said shroud assembly comprising:

at least one arcuate shroud section, said shroud section comprising:

a) a base having a fore end and an aft end;

b) a fore rail extending outwardly from said base at said fore end, said fore rail having a proximal end and a distal end; and c) an aft rail extending outwardly from said base at said aft end, said aft rail having a proximal end and a distal end, said aft rail having a cooling hole formed therein;

a pan-shaped baffle disposed in relation to said shroud section so as to form a shroud section cavity in cooperation with said shroud section, said baffle incorporating at least one supplemental hole located in said baffle, said supplemental hole in fluid communication with both a source of pressurized cooling air and said cooling hole, said supplemental hole aligned with respect to said cooling hole such that cooling air flow travels in a substantially direct path from said supplemental hole to said cooling hole.

4. The shroud assembly of claim 3 wherein said cooling hole is disposed at an angle T toward or away from the axial centerline of said shroud section in a tangential direction.

5. The shroud assembly of claim 4 wherein said angle T is in the range from about 20 degrees to about 70 degrees.

6. A shroud assembly for a gas turbine engine having a high pressure turbine and a turbine rotor carrying a plurality of radially extending turbine blades, said shroud assembly comprising:

a plurality of arcuate shroud sections circumferentially arranged to surround the turbine blades, each said shroud section comprising:

a) a base having a fore end and an aft end;

b) a fore rail extending outwardly from said base at said fore end, said fore rail having a proximal end and distal end; and c) an aft rail extending outwardly from said base at said aft end, said aft rail having a proximal end and a distal end, said aft rail having a cooling hole formed therein;

a plurality of shroud hangers; and at least one generally arcuate retainer for holding said shroud sections in engagement with said shroud hangers, said shroud assembly further comprising a pan-shaped baffle affixed to each shroud hanger so as to define a baffle plenum, each shroud hanger including at least one metering hole therein in fluid communication with the corresponding baffle plenum, wherein said shroud assembly further incorporates at least one supplemental hole located in said baffle, said supplemental hole in fluid communication with both said baffle plenum and said cooling hole, said supplemental hole aligned with respect to said cooling hole such that cooling air flow travels in a substantially direct path from said supplemental hole to said cooling hole.

7. A shroud section for a gas turbine engine, said shroud section comprising:

a base having a fore end and an aft end;

a fore rail extending outwardly from said base at said fore end thereof, said fore rail having a proximal end and a distal end; and an aft rail extending outwardly from said base at said aft end thereof, said aft rail having a proximal end and a distal end, said aft rail having a cooling hole formed therein, wherein said cooling hole is disposed at an angle T measured in a tangential direction from the axial centerline of said shroud section, said angle T being in the range from about 20 degrees to about 70 degrees.

8. The shroud section of claim 1 wherein said angle T is in the range from about 35 degrees to about 55 degrees.

9. The shroud section of claim 1 wherein said angle T is in the range from about 39 degrees to about 44 degrees.

* * * * *